US005494189A

United States Patent [19]

De Crane

[11] Patent Number: 5,494,189

[45] Date of Patent: Feb. 27, 1996

[54] METERING DEVICE USING METERING GATE DISCHARGER

[76] Inventor: Charles E. De Crane, 802 Janna St., West Monroe, La. 71291

[21] Appl. No.: 249,135

[22] Filed: May 26, 1994

[51] Int. Cl.[6] ..... B65D 37/00

[52] U.S. Cl. ..... 222/1; 222/105; 222/154; 222/181.2; 222/504; 222/529

[58] Field of Search ..... 222/1, 105, 154, 222/156, 181.2, 502, 503, 504, 525

[56] References Cited

U.S. PATENT DOCUMENTS

| | | | |
|---|---|---|---|
| 2,681,751 | 6/1954 | Stone et al. | 222/504 X |
| 2,713,507 | 7/1955 | Garlinghouse | 222/504 X |
| 3,072,295 | 1/1963 | Lovette | 222/503 X |
| 3,089,622 | 5/1963 | Westlake, Jr. | 222/529 X |
| 3,532,255 | 10/1970 | Norris et al. | 222/146.6 |
| 4,527,716 | 7/1985 | Haas et al. | 222/105 X |
| 4,646,357 | 2/1987 | Nattrass | 222/105 X |
| 4,966,311 | 10/1990 | Taylor | 222/105 |
| 5,033,706 | 7/1991 | Poulton | 222/105 X |
| 5,184,759 | 2/1993 | Gill et al. | 222/529 X |
| 5,322,195 | 6/1994 | Ellis | 222/504 X |

FOREIGN PATENT DOCUMENTS

| | | | |
|---|---|---|---|
| 381285 | 11/1989 | Germany | 222/504 |

*Primary Examiner*—Andres Kashnikow

*Assistant Examiner*—Kenneth Bomberg

*Attorney, Agent, or Firm*—Norvell E. Von Behren

[57] ABSTRACT

A metering device for controlling the flow of bulk material, contained in a bulk material container, out through a flexible pouring spout on the bulk material container, so that the flexible pouring spout may be tied shut and later un-tied for re-use of the bulk material container. The metering device is positioned below the bulk material container which is to be emptied, upstream from the plant process operation which is to receive the bulk material from the container. A metering gate discharger, contained within the metering device, provides accurate batching from the bulk material container as well as the ability to completely empty the bulk material container at one time without metering the contents. The discharger has two meter gates that accurately control the flow of the bulk material through the flexible pouring spout and into the plant process operation while permitting a pre-determined portion of the pouring spout to move through the metering gates, to a position below the metering gates, permitting that portion of the flexible pouring spout to be tied tightly shut and to be later un-tied as desired. Each meter gate has formed thereon, on an upstream portion of the gate, a centrally positioned, upward facing concaved area which is specifically designed to aid the downward movement of the pre-determined portion of the flexible pouring spout as the meter gates are closing, so that the pre-determined portion of the flexible pouring spout is exposed below the meter gates and is not bunched up above the meter gates.

10 Claims, 4 Drawing Sheets

METERING DEVICE USING METERING GATE DISCHARGER

BACKGROUND OF THE INVENTION

This invention relates generally to a metering device and particularly to a new and novel device which may be used for controlling the flow of bulk materials, contained in a large bulk bag or container, out through a bottom pouring spout on the bulk bag or container so that the pouring spout may be tied shut and later un-tied for re-use of the bulk material container.

In the use of large bulk bags for shipment to a customer and for storage and movement of bulk materials in the customers plant operation, the bulk bag container generally has a flexible bottom pouring spout for removal of the bulk material as desired into the plant operation. The bottom pouring spout generally is approximately 14 to 18 inches in diameter and may be approximately 18 to 20 inches long. The bulk bags are moved by uppers bag loops by lifting devices and the bags also have lower tying straps or cords attached to the lower bag pouring spout. These tying straps are used to tightly tie the spout shut prior to the bag being filled. The tying straps may also be later untied by a worker inside the customers plant whenever it is desired to empty or partially empty the contents of the bag.

Whenever it is desired to partially or completely empty the bulk bag at a plant process location, a worker or workers must first position the bag pouring spout on the lower portion of the bag at the proper location above the plant process. Thereafter, the worker or workers must untie the tightly tied straps or cords so that the bulk material can flow from the bulk bag as desired.

If the bag is to be completely emptied into a plant process, the release of the tying straps is relatively easy. But whenever the bulk materials in the bag need to be partially emptied and metered into a plant process, for example in mixing of several bag contents into the process, the stopping of the bulk material flow through the pouring spout at some intermediate point can be extremely difficult, if not impossible, for the worker or workers. This is due to the quick discharge of the bulk product from the bag through the pouring spout as well as the heavy weight of the bulk contents still remaining in the bag and the difficulty of closing off and tying off the pouring spout.

Problems can occur with oppositely positioned metering gates that swing up to close the flexible pouring spout. During the closing of the flat metering gates, the round flexible pouring spout is squeezed between the closing gate edges and is compressed into a generally rectangular shape between the meter gate edges. Portions of the circular flexible pouring spout will be raised upwardly by the closing gates and these portions do not easily pass between the closing meter gate edges to a position below the meter gate where they can be tied off. The portions of the flexible pouring spout that do not pass through the meter gates will tend to bunch up sufficiently to prevent the later tying off of the lower portion of the spout since not enough of the pouring spout is exposed beneath the meter gate.

Environmental problems, such as dust and hazardous material contaminants, can also hinder the worker that must tie up the flexible pouring spout. These environmental problems can be encountered where dusty and/or hazardous bulk material product are contained in the bulk container. Poor environmental conditions often require the use of a sealed hopper into which the flexible pouring spout is positioned and exterior dust controls for removal of product dust and hazards. With the use of a hopper for directing the flow of bulk materials from the bag, gauntlet type hand and arm access as well as visual access must be provided for the worker to be able to see the pouring spout and to accomplish the untying of the bag straps on the bottom portion of the pouring spout without being exposed to the hazard.

The manual untying and re-tying of the pouring spout straps by the worker or workers and control of the product flow, can also be very difficult due to the weight of the bulk materials contained in the bag. The material weight in the bag and in the pouring spout will exert a downward force at the pouring spout that must be offset by the physical strength of the worker as the straps on the flexible spout are untied or are re-tied. Because of this, whenever a customer needs to pour smaller amounts of a bulk product into a batching operation, he usually must resort to using smaller sizes of bags to handle the lesser amounts of product needed since prior art mechanical device are not available to aid the operator.

SUMMARY OF THE INVENTION

In order to overcome the problems inherent in the prior art handling of bulk materials pouring spouts in the field at a plant location and to provide batching capabilities using large bulk material bags and/or containers, there is provided a new and novel solution to the problem. The applicant's unique design utilizes a metering device which is positioned below the bulk material container which is to be emptied. The metering device is also positioned upstream from the field operation of the customers process which is to receive the bulk product from the bag.

The metering device of the preferred embodiment uses an upstanding frame upon which the bulk bag may be positioned. The frame contains a hopper which is fixedly attached to the frame. The hopper contains gauntlet hand and arm access in the form of a pair of protective gloves which the worker can use to untie the pouring straps without having his body exposed to dust or contamination from the bulk product. The worker can also view the pouring spout through a visual observation window attached to the hopper.

The hopper also contains a unique metering gate discharger in proximity to the arm and hand access gauntlet and which is positioned within the open top portion of the hopper. The novel metering gate discharger receives the tightly tied flexible pouring spout and functions to clamp or pinch the flexible pouring spout, as desired, and to hold back the flow of bulk materials while the tying straps or cords can be untied or re-tied by the worker. The bulk material bag may be partially emptied or completely emptied as desired. When the bag is to be partially emptied, as in a batching operation where mixing of several bag contents is needed, the novel metering gate discharger serves to accurately control the flow of bulk materials through the flexible pouring spout and into the plant process operation as desired while permitting portions of the pouring spout to move through the metering gates to a position below the metering gates. This movement permits that portion of the flexible pouring spout to be tied tightly shut and to be later un-tied as desired.

In the preferred embodiment, to be described in detail hereafter, the metering gate discharger comprises a pair of pivotally mounted meter gates spaced apart and designed to move toward and away from each other with the flexible pouring spout being positioned between the moving gates.

Each meter gate has formed thereon, on the upstream portion of the gate, a centrally positioned, upward facing concaved area which is specifically designed to aid the downward movement of a portion of the flexible pouring spout as the meter gates are closing so that enough of the flexible pouring spout is exposed below the meter gates and is not bunched up above the meter gates.

With the novel concaved area on the metering gates, the meter gates are designed to later clamp the circular flexible pouring spout after allowing portions of the flexible spout to move downwardly through the meter gates as the gates are being closed above the tied straps or cords. When this occurs, the tying straps are positioned below the meter gates and can be easily untied or re-tied. The two meter gates in the metering gate discharger are also used to meter the flow of material through the pouring spout using pneumatic means positioned inside of the hopper to control the position of the meter gates. The position of the meter gates is controlled by pneumatic circuitry and may also use a remotely mounted control station in proximity to the applicant's metering device.

The applicant's novel metering gate discharger, contained within the metering device, provides accurate batching, by weight, from large bulk bags or containers as well as the ability to completely empty a bulk bag at one time without metering the contents. The discharger features two meter gates that are used to measure out pre-determined amounts of bulk product, and then to immediately cut off the flow of bulk product through the flexible pouring spout. This allows the worker operator to be able to quickly tie off the pouring spout straps or cords using the easy access gauntlet arm and hand openings. When this is accomplished, the operator may later discharge the remaining product contained in the partially emptied bag.

The applicant's novel invention can be used for start and stop operation of the flow of bulk product through the pouring spout as would be used for accurately and controlled metering of product flow in the pouring spout for a batch mixing or batching plant process. The novel invention can be used as a semiautomatic unit which is operated by the remote push button control station.

Accordingly it is an object and advantage of the applicant's invention to provide a novel metering gate discharger which can tightly clamp and unclamp the pouring spout of a bulk bag without permitting bunching up of portions of the pouring spout above the meter gates and can also meter the flow of bulk materials through the flexible pouring spout for controlled metering.

Another object and advantage of the applicant's invention is to provide a unique metering device which uses the metering gate discharger for a plant batching operation to be able to accurately batch, by weight, without having to use a worker or several workers to hold the bulk product in the pouring spout while attempting to tie and untie the flexible spout.

A further object and advantage of the applicant's invention is to provide a novel method of quickly and accurately controlling the flow of bulk materials in a flexible pouring spout using the novel metering device and the contained metering gate discharger.

Yet another object and advantage of the applicant's invention is to provide a novel metering device and a novel metering gate discharger used in the metering device that can empty a specified portion of bulk product from a customers bulk bag into his plant process with no residual bulk product being left in the hopper used in the metering device.

These and other object and advantages of the applicant's invention will become apparent by studying the drawings showing the invention and by reading the Description of the Preferred Embodiment, contained hereafter, which is given by way of illustration only.

DESCRIPTION OF THE PREFERRED EMBODIMENT

Figure 1:
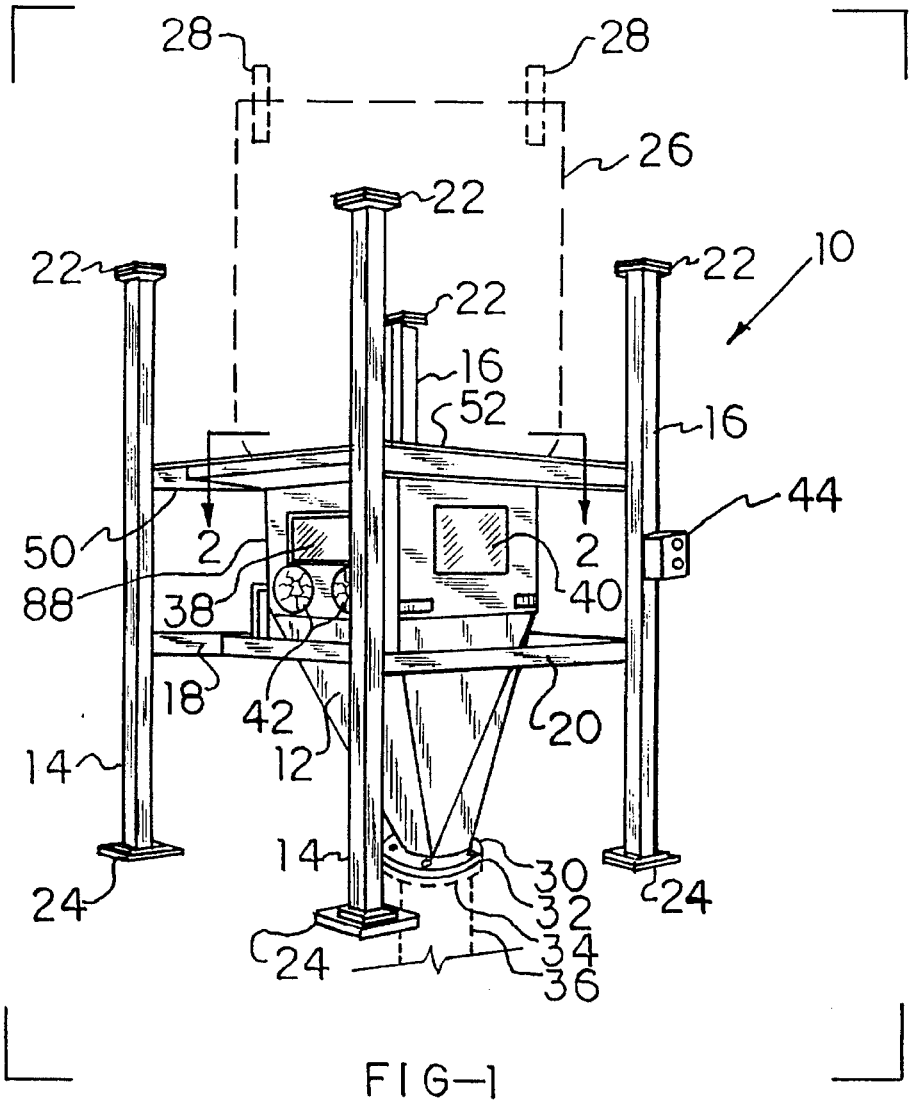
FIG. 1 is a perspective view of the applicant's metering device of the preferred embodiment showing a large bulk bag, in dotted lines, positioned on top of the metering device and further showing, in dotted lines, the metering device connected, at the bottom thereof, to a customers process piping.

Turning now to the drawings in general and in particular to FIG. 1 of the drawings, there is shown in FIG. 1, a perspective of the applicant's novel metering device 10 of the preferred embodiment. The metering device 10 contains a hopper 12 which is fixedly attached to an outer frame comprising a pair of front upright frame members 14 and a pair of upright rear frame members 16. Lower cross members 18 and 20 rigidly hold the front and rear frame members 14 and 16 together in the upright position shown in FIG. 1 of the drawings.

The frame structure has attached thereto, at the top, a plurality of upper mounting plates 22 and has similar lower mounting plates 24 as shown for mounting the frame at a customers plant location. The metering device 10 is designed to hold a large bulk material bag or container, shown in dotted lines 26 in FIG. 1. The bag 26 has a pair of bag loops 28 attached to the top thereof for moving the bulk material bag 26. The bag 26 also has a lower pouring spout 58 with tying straps or cords not shown in FIG. 1 of the drawings.

The hopper 12 has an open top for receiving the bottom portion of the bag with its flexible pouring spout 58 (not shown in FIG. 1). The hopper 12 also has an open bottom portion 30 with an outlet flange 32 which may be attached to a mating inlet flange 34 shown in dotted lines in FIG. 1. The inlet flange 34 would be connected to the customers process piping shown in dotted lines 36 in FIG. 1 of the drawings.

The hopper 12 also contains a front observation window 38 and a side observation window 40 for use by the worker operator in positioning the bulk bag pouring spout within the hopper and for untying the pouring spout 58 spout as desired. The hopper 12 also has a pair of gauntlet arm and hand access openings 42 which have arm and glove protection attached for use by the worker. These protect the worker from exposure to the chemical or bulk material contained within the bulk bag 26 and from dust exposure as the contents of the bag 26 are emptied. A control box 44, for operating the metering device, is attached to the frame structure as shown.

Figure 2:
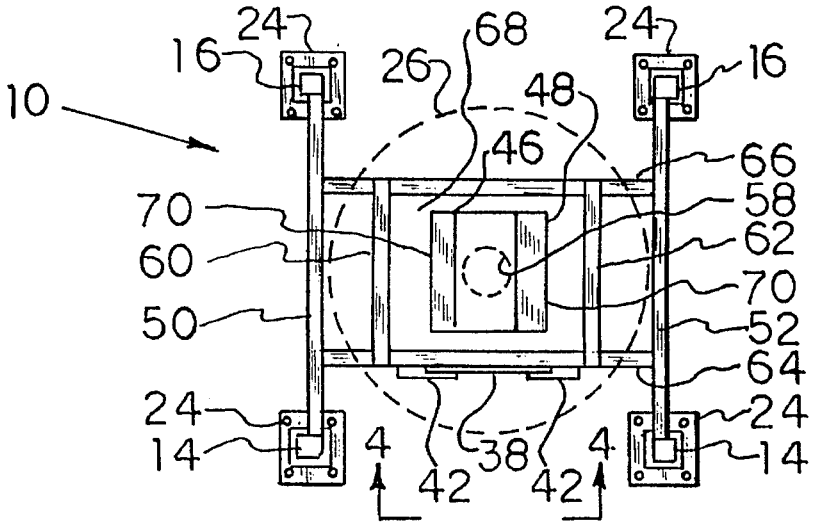
FIG. 2 is a top plan view, taken along lines 2—2 of FIG. 1, showing the entrance to the metering gate discharger unit used in the applicant's metering device and showing two meter gates positioned with the bulk bag pouring spout being shown positioned between the meter gates.

Turning now to FIG. 2 of the drawings, there is shown a top plan view, taken along lines 2—2 of FIG. 1, of the entrance to the hopper 12 which contains the applicant's unique metering gate discharger to be described more fully hereinafter. The upper cross members 50 and 52 also provide rigid support to the frame and support to the filled bulk bag 26 with it's bottom flexible pouring spout 58 shown dotted in FIG. 2 of the drawings. The inner cross members 60 and 62 as well as the front and rear cross members 64 and 66 also provide a support for the hopper 12 and for the flat surface 68 upon which the bottom of the bulk bag can rest when emptying the contents into the hopper 12.

The flat surface 68 contains a large opening 70 through which the viewer can observe portions of the meter gates used in the subject invention. Two meter gates 46 and 48 are shown in FIG. 2 of the drawings to block and/or meter the flow of bulk product through the pouring spout. These meter gates 46 and 48 can be used to operate and to clamp or pinch the bulk bag pouring spout 58 shown dotted in FIG. 2 of the drawings to prevent flow of bulk material through the spout.

Figure 3:
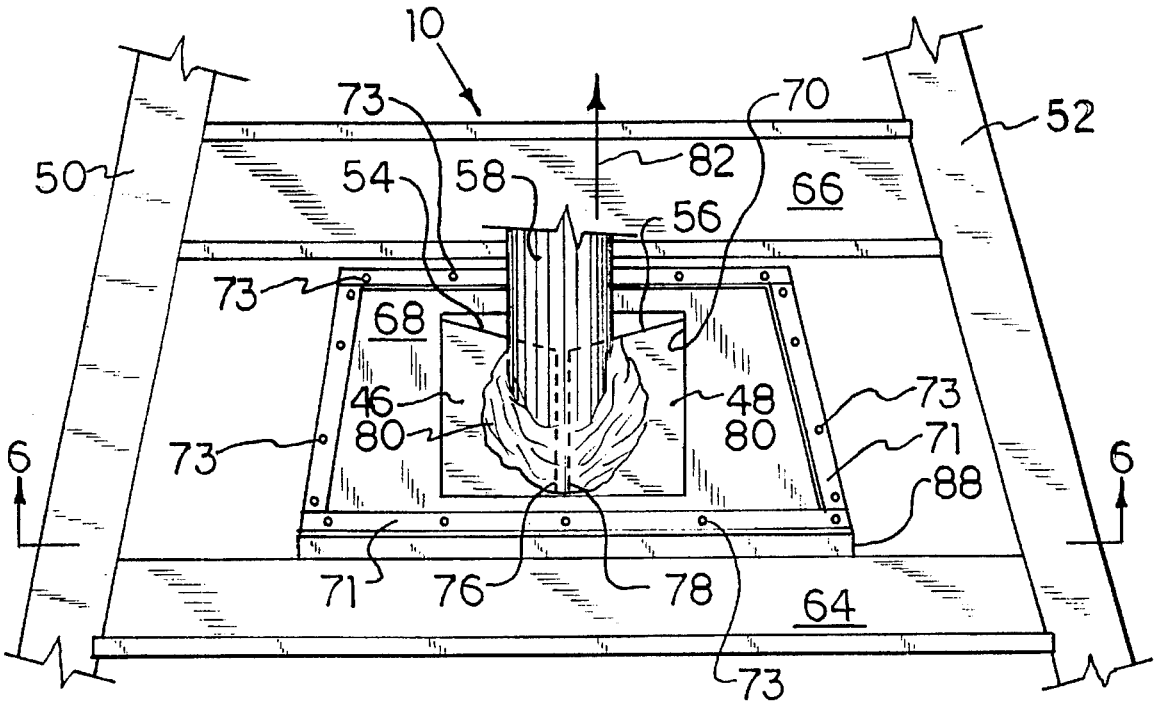
FIG. 3 is an enlarged front elevational perspective view, taken generally in the same direction as lines 2—2 of FIG. 1, showing how an upwardly moving flat surface type meter gate can cause bunching of the flexible pouring spout as the meter gates are being closed. The meter gates are shown in FIG. 3 in a closed or clamped position with a bulk bag spout, shown in dotted lines, being positioned between the meter gates as it would be during flow of bulk product out of the metering device, through the bag spout, to the customers process positioned below the device.

Turning now to FIG. 3 of the drawings, there is shown an enlarged front elevational perspective view, taken generally in the same direction as lines 2—2 of FIG. 1. A frame 71 tightly clamps the flat sealing surface 68 to the upper portion of the hopper 88 by a plurality of bolts 73. FIG. 3 also shows how the use of a pair of old style meter gates 46 and 48, which normally will have a flat upper surface 54 and 56, can cause bunching up of portions of the flexible pouring spout 58 above the meter gate upper surfaces 54 and 56. The bunched up portions of the pouring spout 58 are shown as numeral 80 in FIG. 3 of the drawings.

When using an old style flat surfaced meter gate 46 and 48, as the meter gate edges 76 and 78 of the meter gates 46 and 48 close upwardly in the direction shown by the arrow 82, the rectangular space between the closing meter gates 46 and 48 acts to force the circular shaped pouring spout into a rectangular shape. When this happens, the flat upper surfaces 54 and 56 of the meter gates 46 and 48 prevent the circular pouring spout 58 from moving or passing down through the closing meter gates 46 and 48. As a result, portions of the pouring spout cannot slide or move between the closing space between the meter gates and will bunch up, shown as the numeral at 80, above the meter gates.

As a result, there is not enough of the pouring spout 58 which can pass beneath the meter gates 46 and 48 to permit the operator to tie the pouring spout 58 shut as has been before described. This unusual problem has been eliminated by the applicant's novel design of his unique meter gates 72 and 74 shown in FIGS. 4–8 of the drawings. In FIG. 3, the old style meter gates 46 and 48 are shown with a flat upper surface 54 and 56 in order to try to clearly illustrate the problem encountered in using the old style flat surfaced meter gates 46 and 48.

The applicant's novel meter gate improvement, to be described in more detail hereinafter when referring to FIGS. 4–8 of the drawings, utilizes a unique meter gate design with top surfaces 98 and 100 (shown in FIGS. 4–5) that allows the pouring spout 58 to retain it's circular shape and to move or pass through the closing meter gates 72 and 74 to a position below the meter gates. This unique design assures that there will be enough of the pouring spout 58 below the meter gates 72 and 74 so that they may be easily and tightly tied or untied.

Figure 4:
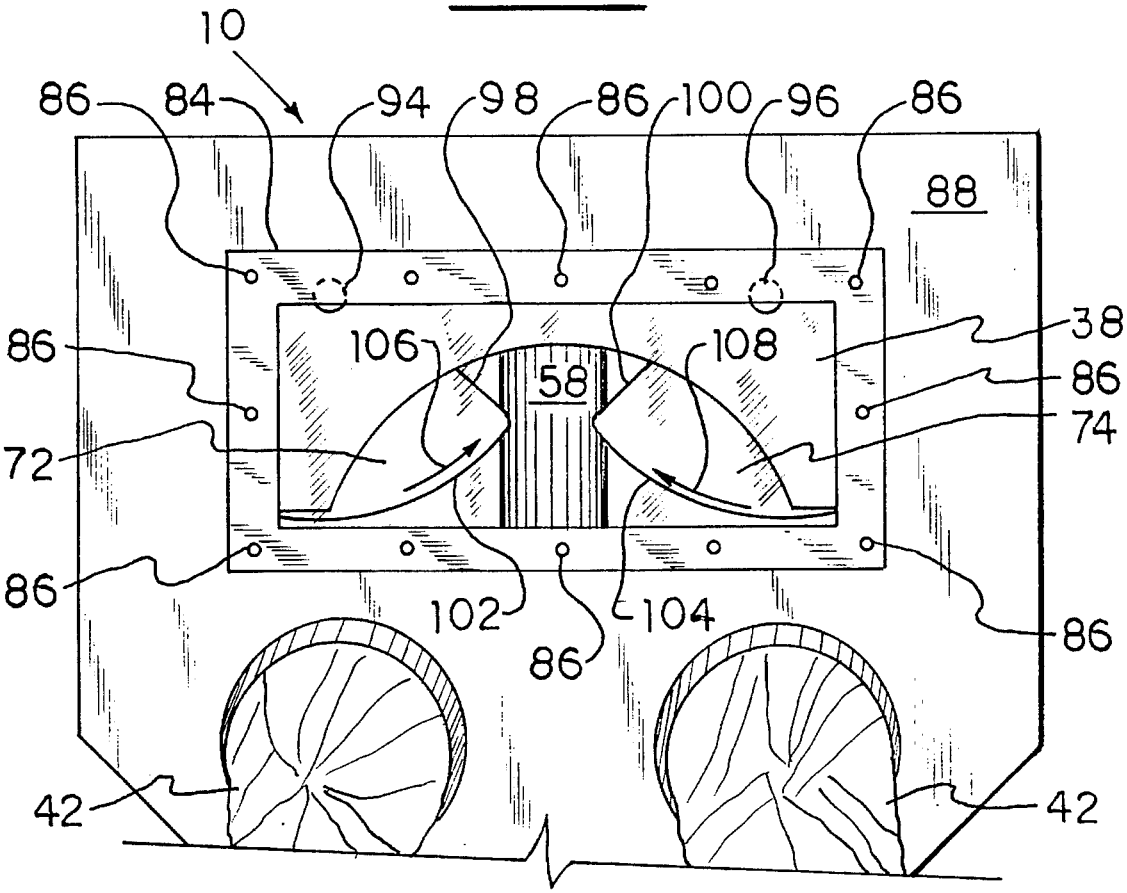
FIG. 4 is a side elevational view, taken along lines 4—4 of FIG. 2 of the drawings, showing the top portion of the hopper used in the applicant's metering device as looking through the front observation window and showing the novel design of the applicant's meter gates in the process of closing for clamping the flexible bag spout so that bulk product can not flow through the bag spout while it is tied shut.

Turning now to FIG. 4 of the drawings, there is shown a side elevational view, taken along lines 4—4 of FIG. 2 of the drawings, showing in detail the construction of the applicant's metering device 10 and the construction of the applicant's novel improved meter gates 72 and 74 as before described. The upper portion 88 of the hopper contains an observation window 38 in juxtaposition to the meter gates 72 and 74. The observation window 38 is held in place by the observation window frame 84 using a plurality of bolts 86. The pair of meter gates 72 and 74 are spaced apart as can be seen in the observation window 38 and have the flexible pouring spout 58 shown positioned between the gates. The meter gates 72 and 74 are supported by and are attached to the horizontal shafts 94 and 96 carried by the upper portion 88 of the hopper. The meter gates 72 and 74 pivot on the shafts 94 and 96 in the direction shown by the arrows 106 and 108 as will be described more fully hereinafter. These unique meter gates have novel shaped upper surfaces 98 and 100 and also have lower curved surfaces 102 and 104.

Figure 5:
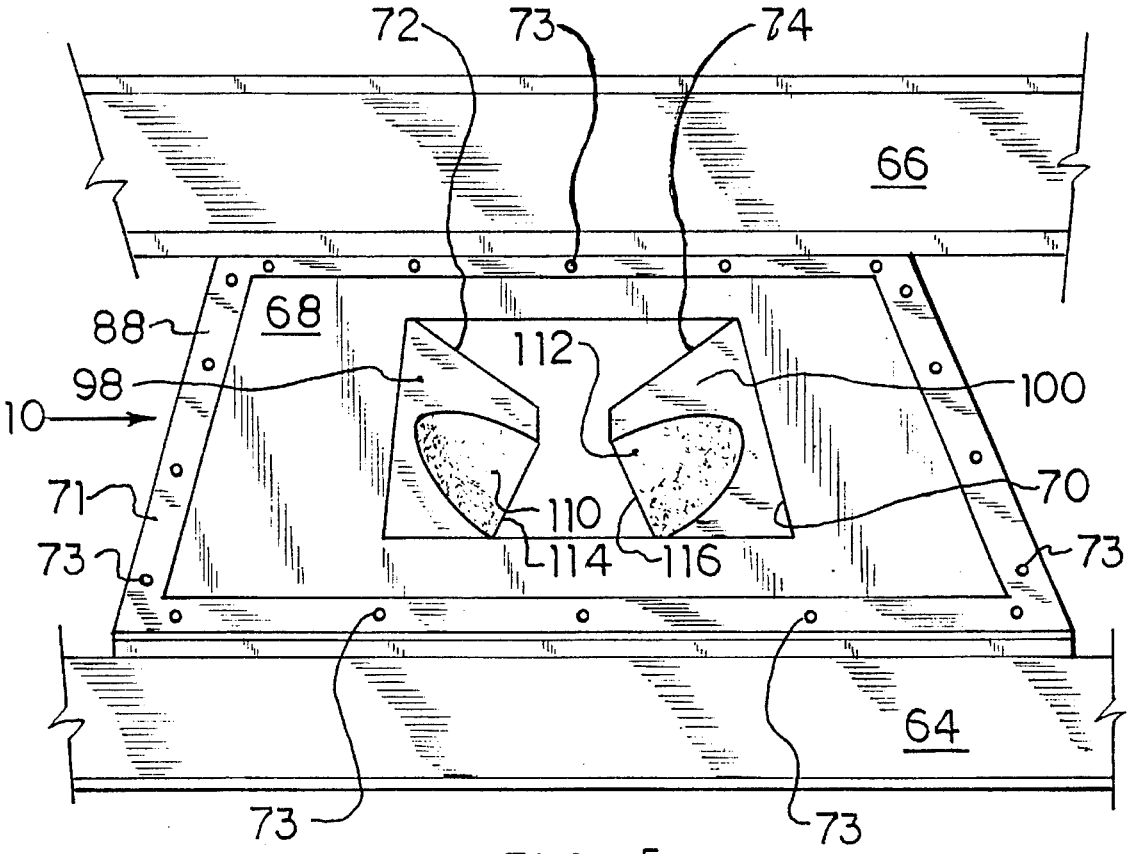
FIG. 5 is an enlarged perspective view, similar to the view of FIG. 3, showing the novel construction of the applicant's meter gates using the centrally positioned, upward facing concaved areas to prevent the before described bunching up of the pouring spout above the meter gates which was illustrated in FIG. 3 of the drawings.

Referring now to FIG. 5 of the drawings, there is shown an enlarged perspective view, similar to the view of FIG. 3 showing the novel construction of the applicant's meter gates 72 and 74 using the centrally positioned, upward facing concaved areas 110 and 112 to prevent the before described bunching above the meter gates 72 and 74. In FIG. 5, the top portion 88 of the hopper 12 is shown and the applicants novel design of the meter gates 72 and 74 are shown in a position with the gates being shown as they would close together.

In FIG. 5, the flexible pouring spout 58 has been deleted for convenience in order to be able to see the novel design of the top surfaces 98 and 100. These surfaces have formed thereon upward facing concaved areas 110 and 112 in the upper surfaces 98 and 100 of the meter gates 74 and 76 the upward facing concaved areas 110 and 112 having an axis perpendicular to a pivotal axis of the meter gates 74 and 76. The curved surfaces 114 and 116 on the curved lower surfaces 102 and 104 of the meter gates act as closing and pinching surfaces as the meter gates rotate upwardly in the direction of the arrows 106 and 108 (shown in FIG. 4).

The square opening 70 formed in the flat hopper gasket sealing surface 68 permits the observer to see the meter gates 72 and 74 and also permits the bag pouring spout 58 to be positioned inside the hopper 12 and between the metering gates 72 and 74. The flat hopper gasket sealing surface 68, shown in FIG. 5 of the drawings, is attached to the upper portion 88 of the hopper 12 by the frame 71 and the bolts 73 which hold the gasket seal 68. If the customer desires, a pair of bag actuators may be provided and may be attached to the cross members 64 and 66. The bag actuators may be used to vibrate the bottom of the bulk bag 26 to aid in flowing the bulk material out through the pouring spout 58.

Figure 6:
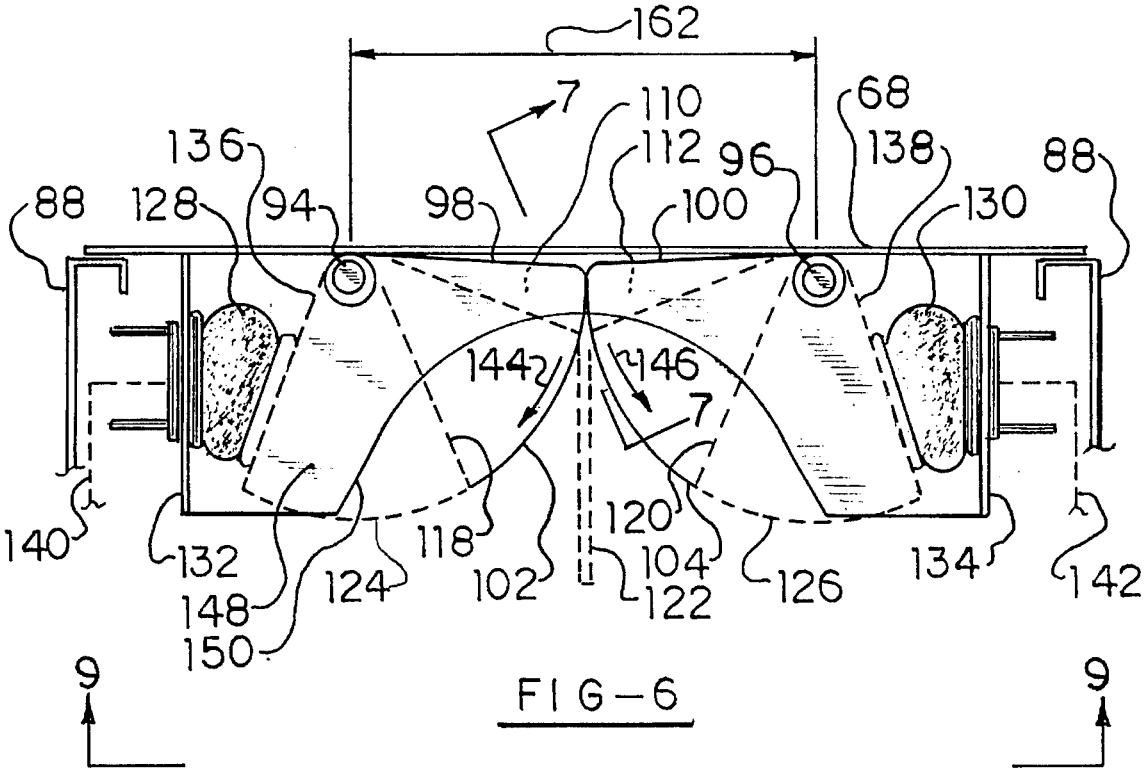
FIG. 6 is a cross sectional view, taken along lines 6—6 of FIG. 3 showing the applicant's novel designed meter gates and showing the operating range of each pivoted meter gate and the air bags used to operate the gates as desired.

Referring now to FIG. 6 of the drawings, there is shown a cross sectional view, taken along lines 6—6 of FIG. 3. FIG. 6 shows in more detail the applicant's novel meter gates 72 and 74. FIG. 6 also shows the operating range of the meter gates 72 and 74 and the mounting position of the air bags 128 and 130 used to rotate the meter gates 72 and 74.

As before mentioned, the meter gates 72 and 74 are mounted for rotation on the shafts 94 and 96. When the meter gates 72 and 74 are in the closed or clamped position, the upper surfaces 98 and 100 of the meter gates 72 and 74 are tightly closed as shown in FIG. 6. The lower surfaces 102 and 104 of the meter gates 72 and 74 are curved as shown and form the lower surfaces 102 and 104 before described. In FIG. 6, the portion of the flexible pouring spout 58 that has passed through the closing meter gates 72 and 74 is shown dashed using the numeral 122.

The upper surfaces 98 and 100 of the meter gates 72 and 74 will be positioned, when fully open, in the dotted position 118 and 120. The curved bottom surfaces of the meter gates 72 and 74 are shown dashed in FIG. 6 and use the numerals 124 and 126 when the meter gates are in the open position.

A pair of air bags 128 and 130 are attached to the mounting plates 132 and 134 as shown and attach to the back surfaces 136 and 138 of the meter gates 72 and 74. The meter gates 72 and 74 swing down by gravity in the direction shown by the arrows 144 and 146 when air is released from the air bag. They are raised upwardly as shown by the arrows 106 and 108 (shown in FIG. 4) when the air bags are activated through the pneumatic system. A pneumatic air line 140 and 142 connects to each air bag to activate or deactivate them. A side plate 148 is positioned on each side of the meter gates 72 and 74 and contains an arcuate cut 150 in the side plates in order to be able to view the meter gates 72 and 74. The shafts 94 and 96 are spaced apart the distance of approximately 15⅛ inches as shown by the numeral 162.

Figure 7:
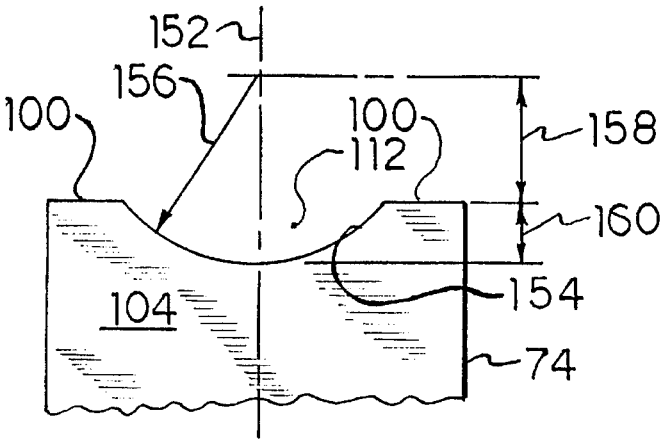
FIG. 7 is an elevational view, taken along lines 7—7 of FIG. 6, showing in more detail the position of the centrally positioned, upwardly facing concaved areas on the meter gates.

Referring now to FIG. 7 of the drawings, there is shown an elevational view, taken along lines 7—7 of FIG. 6 of the drawings, and showing in more detail the design of the centrally positioned, upwardly facing concaved area 112 of the meter gate 74. The opposite meter gate 72 is constructed in a similar manner with a concave area 110 as can be seen in FIG. 5 of the drawings. There can be seen in FIG. 7, the lower surface 104 of the meter gate 74 and how the centrally positioned concaved area 112 is formed therein. The numeral 152 represents the center line of the meter gate 74 and a radius of approximately 6 inches, shown by the numeral 156, is used to form the surface 154 of the concaved area 112. The radius 156 is formed approximately 4 inches above the upper surface 100 as shown by the numeral 158. This then places the base of the concaved area approximately 2 inches below the upper surface 100 of the meter gate as shown by the numeral 160. When both meter gates 72 and 74 are formed thusly, the meter gates have an arcuate area 172 formed between the opposing meter gates.

Figure 8:
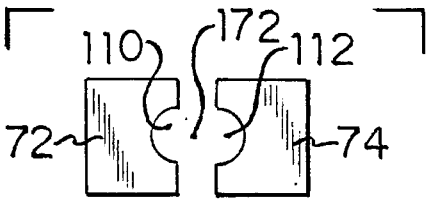
FIG. 8 is a reduced elevational view, similar to the view of FIG. 7, showing two meter gates positioned adjacent to each other as the gates are pivoted together to close the gates.

Referring now to FIG. 8 of the drawings there is shown an elevational view, similar to the view of FIG. 7, showing both meter gates 72 and 74 positioned with their respective concaved areas 110 and 112 forming the arcuate area 172 as before described. The formed arcuate area 172 closely approximates the round circular area of the various flexible pouring spouts that may be used on the applicant's device. As a result, the unique construction permits portions of the flexible pouring spout to move or pass through the arcuate area 172 instead of bunching up above the meter gates as illustrated in FIG. 3 of the drawings.

As the meter gates 72 and 74 close tightly together, the arcuate area 172 will become smaller and smaller and will turn into a rectangular area of sufficient size until the closing surfaces 114 and 116 come together as the meter gates rotate. This will pinch off the flexible pouring spout positioned between the meter gates. As a result of the use of the concaved areas 110 and 112, sufficient amounts of the pouring spout 58 will move between the closing gates to beneath the meter gates to permit the pouring spout 58 to be tied beneath the meter gates 72 and 74.

Figure 9:
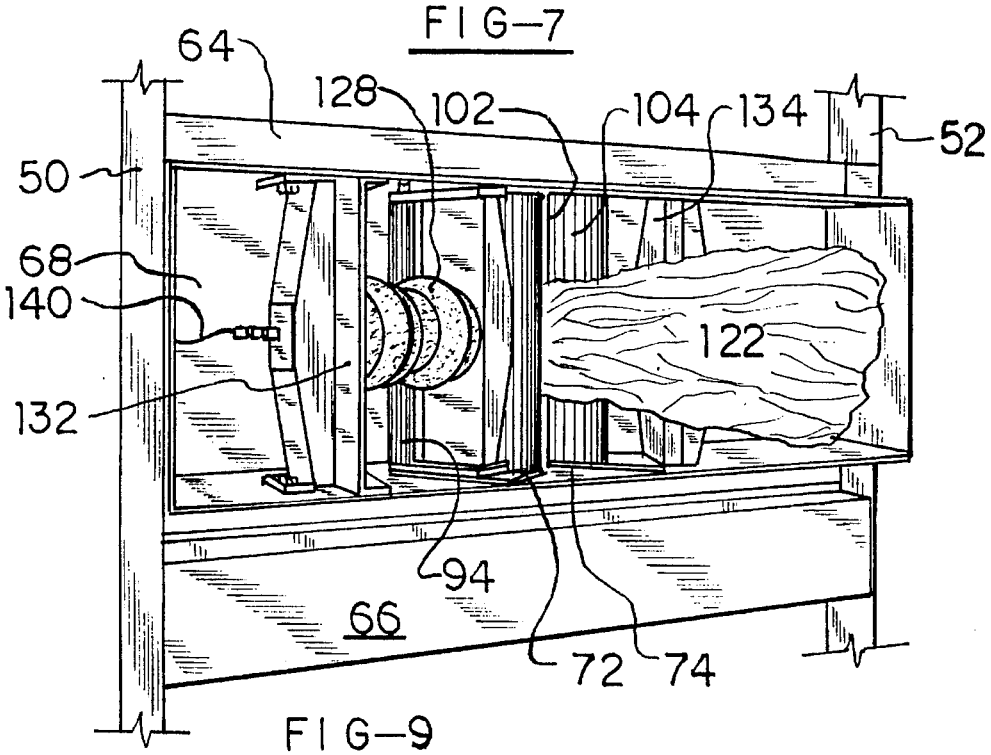
FIG. 9 is a bottom perspective view, taken generally along the lines of 9—9 of FIG. 6, showing in more detail how the portions of the flexible pouring spout have moved to a position beneath the upwardly moving meter gates as the gates are closed as a result of using the concaved areas on the upper portion of the meter gates.

Referring now to FIG. 9 of the drawings, there is shown a bottom perspective view, taken generally along the lines of 9—9 of FIG. 6 showing in more detail how the portions of the flexible pouring spout 58 have moved to a position beneath the upwardly moving meter gates 72 and 74. There can also be seen in FIG. 9, the formation and mounting of the meter gates 72 and 74 on the device. FIG. 9 also shows the mounting of the air bag 128 which moves the meter gate 72. The other air bag 130 is similarly mounted to move the meter gate 74. The portions of the flexible pouring spout that have moved below the meter gates, as before described, is shown as the numeral 122. This amount represents the portion of the pouring spout that will be tied off by the operator of the metering device using the tying straps.

Figure 10:
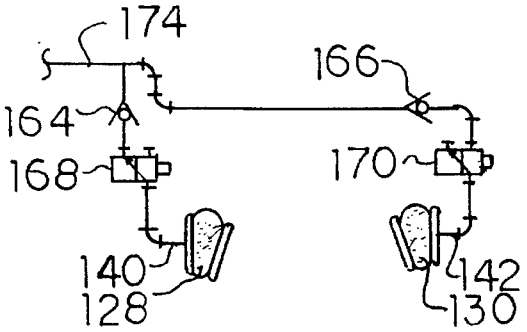
FIG. 10 is a schematic diagram of the pneumatic circuitry used in the preferred embodiment to operate the air bags used to close the meter gates.

Referring now to FIG. 10 of the drawings, there is shown a schematic diagram of the pneumatic circuitry used in the preferred embodiment to operate the air bags 128 and 130 used to close the meter gates 72 and 74. A plant air supply 174 is connected to a pair of check valves 164 and 166 and then to the solenoid valves 168 and 170. The valve 168 is the bulk valve and the valve 170 is the bulk and dribble valve which is used to meter a given amount of flow through the pouring spout 58. The air bags 128 and 130 are then activated through the pneumatic lines 140 and 142 from the solenoids 168 and 170.

Figure 11:
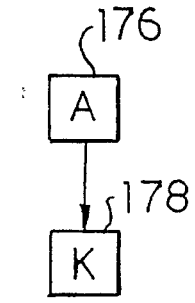
FIG. 11 is a schematic representation of the method of the invention.

Referring now to FIG. 11 of the drawings, there is shown a schematic representation of the steps of the applicant's novel method. There will now be described the operation of the applicant's novel metering device as applied to the steps (a)–(k) used in the method of the invention. In step (a), shown by the numeral 176 in FIG. 11 of the drawings, of the method for quickly and accurately controlling the flow of bulk materials, there is first provided a metering device having a metering gate discharger contained within the metering device. The metering device has a hopper with an open top portion and with an open bottom portion. The hopper receives the tightly tied flexible pouring spout of the bulk material container used by a customer.

In step (b), there is provided on the metering gate discharger, means for preventing bunching of portions of the flexible pouring spout within the hopper and above the metering gate discharger. In the next step (c), the metering device is positioned upstream of the plant operation and below the bulk material container so that the metering device can be used to release and to control the flow of bulk material from the pouring spout as desired, either all at once or by metering it in controlled amounts. This permits the bulk material to flow downstream to the customers plant process and portions of the flexible pouring spout to move through the metering gate discharger so that the portions may be tied and later untied for reuse of the bulk material container.

In step (d) of the operation and the method, the tightly tied flexible pouring spout of the bulk material bag is inserted within the metering gate discharger between the meter gates of the discharger while the bulk material bag or container is positioned on top of the hopper.

In step (e), the metering gate discharger is operated to clamp the tightly tied flexible pouring spout above the tied portion of the spout to thereby hold and temporarily retain the bulk material within the pouring spout and within the bulk material container.

In step (f), the tied portion of the flexible pouring spout is untied by a worker operator using gauntlet arm and hand access on the hopper as well as using the observation window to view the pouring spout.

In step (g), the metering gate discharger is operated, as desired, to move portions of the metering gate discharger so as to unclamp the flexible pouring spout and to control the flow of the bulk material, as desired, through the pouring spout and downstream to the plant operation.

In step (h), the metering gate discharger would be operated, when desired, to again clamp the flexible pouring spout when the bulk material container is partially emptied and to stop the flow of the bulk material through the flexible pouring spout.

In step (i), the flexible pouring spout is re-tied tightly shut. In the step (j), the metering gate discharger is operated to again unclamp the re-tied flexible pouring spout to permit the pouring spout to be removed from the metering gate discharger.

In the last step (k), shown by the numeral 178 of FIG. 11, the flexible pouring spout is removed from the metering gate discharger along with the bulk material container from the metering device by lifting the partially filled bulk material container from the metering device.

When the applicant's novel metering device is used for a batch mixing operation, the metering gate discharger would again be operated, when desired, to again clamp the flexible pouring spout when the bulk material container is partially emptied and to stop the flow the bulk material through the flexible pouring spout.

Thereafter, the flexible pouring spout would be re-tied tightly shut. The metering gate discharger would be operated to again unclamp the re-tied flexible pouring spout to permit the pouring spout to be later removed from the metering gate discharger so that the bulk material container can be stored for later use. Finally, the flexible pouring spout would be removed from the open metering gates of the metering gate discharger as the bulk material container would be removed from the metering device by lifting the partially filled bulk material container from the metering device. When it is later desired to empty more contents from a partially empty bulk bag, the worker operator would repeat steps (d) through (k) as desired to further discharge bulk material from the partially filled bulk material container.

From the foregoing, there has been shown and described the preferred embodiment and variations of the applicant's unique metering device, the novel metering gate discharger, with it's unique meter gates used with the metering device and the novel method of the invention. It is apparent that changes may be made in the parts of the invention and the arrangement of the various parts as well as in the steps of the method without departing from the spirit and scope of the invention. Such modifications are considered to be within the spirit and scope of the applicant's invention and the applicant is not to be limited to the exact embodiments shown which are only given by way of illustration only.

Having described my invention, I claim:

1. A metering gate discharger for use by a worker in controlling a flow of a bulk material through a flexible pouring spout and for controlling a movement of the flexible pouring spout as the bulk material flows within the pouring spout through a hopper, from a bulk material container positioned on top of the hopper, the bulk material container having the flexible discharge pouring spout on a bottom of the bulk material container which is capable of being positioned within the metering gate discharger so that a portion of the flexible pouting spout may move downwardly through the metering gate discharger and beneath the metering gate discharger as the discharger is closing, the portion of the flexible pouring spout that moves beneath the metering gate discharger being used so that the spout may be tightly tied shut for later re-use, comprising:

(a) a pair of oppositely positioned moving means positioned within the hopper and mounted for movement within the hopper;

(b) a pair of moveable meter gates, pivotally mounted within the hopper and attached to the moving means, the moveable meter gates being operable between a closed position and an opened position and to desired intermediate positions between the opened and the closed positions, the meter gates being designed to intercept the flexible discharge pouring spout on the bulk material container and to control the flow of bulk materials through the flexible discharge pouring spout as desired by the worker when the pouring spout is positioned within the metering gate discharger;

(1) each meter gate having formed thereon, on an upstream side of the gate, a centrally positioned, upward facing concaved area formed on an upper surface of the gate, the upward facing concaved area having an axis perpendicular to a pivotal axis of the gate, for use in positioning the flexible pouring spout in the concaved area as the meter gates are closed, the concaved area permitting the flexible pouring spout to move between the meter gates as the meter gates are being closed thereby preventing the pouring spout from bunching up on the upstream side of the gate and allowing portions of the spout to move beneath the meter gates; and (c) means, associated with the moving means and positioned in proximity to the hopper, for controlling the movement and position of the moving means and to move the moveable meter gates as desired, within the hopper so that the flow of bulk material may be controlled within the flexible discharge pouring spout by the meter gates as desired by the worker.

2. The metering gate discharger as defined in claim 1 wherein the moving means comprises an air bag actuator positioned on each side of the meter gates and in juxtaposition to the meter gates.

3. The metering gate discharger as defined in claim 1 wherein the means for controlling the movement and position of the moving means is at least one pneumatic means.

4. The metering gate discharger as defined in claim 1 wherein the centrally positioned concaved area on the meter gates is formed with an approximately six inch radius.

5. A metering device used by a worker in controlling a flow of a bulk material form a bulk material container positioned above the metering device through a flexible pouring spout on the bulk material container which is capable of being positioned inside the metering device so that a portion of the flexible pouring spout will be positioned below a metering gate when the metering gate is closed, so that the portion may be tightly tied shut for later reuse of the bulk container, comprising:

(a) a frame;

(b) a hopper, fixedly attached to the frame, the hopper having an open top portion as well as an open bottom portion, the hopper also having formed thereon;

(1) means, associated with the hopper, to provide hand and arm access, by the worker, to the bulk container flexible pouting spout when it is positioned within the metering device hopper so that the worker can untie the tightly tied flexible pouring spout as desired, (2) means, associated with the hopper, to provide visual access by the worker, to the bulk container flexible pouring spout when it is positioned inside of the metering device hopper so that the worker can observe the pouring spout and can also re-tie he pouring spout to tightly shut the pouring spout as desired;

(c) a metering gate discharger, positioned within the open top portion of the hopper, for receiving the bulk container flexible tied pouring spout and for controlling the flow of the bulk material from the bulk material container through the flexible pouring spout when the pouring spout is untied and for controlling movement of a pre-determined portion of the flexible pouring spout as bulk product is discharged through the pouring spout as the metering gate discharger is closed, the metering gate discharger being designed with a pair of moveable meter gates for engaging and clamping the tied flexible pouring spout, the meter gates having means, formed on the meter gates for preventing bunching of the flexible pouring spout within the hopper; and (d) means, associated with the metering device, to move the moveable meter gates a predetermined amount to control the flow of bulk material and to restrict the flow of bulk material from the flexible pouring spout in a controlled manner while permitting the pre-determined portion of the flexible pouring spout to pass through the meter gates as the gates are closed.

6. The metering device as defined in claim 5 wherein the moveable meter gates are spaced apart and are rotatably mounted within the hopper to clamp and to unclamp the flexible pouring spout.

7. The metering device as defined in claim 5 wherein the means to operate the moveable meter gates comprises at least one pneumatic actuator which activates a pair of air bag actuators to rotate the pair of meter gates.

8. In a meter gate assembly having two adjacent pivoting meter gates for use in a metering device, the improvement comprising: each meter gate having formed thereon, on an upstream side of the gate, a centrally positioned, upward facing concaved area formed on an upper surface of the gate, the upward facing concaved area having an axis perpendicular to a pivotal axis of the gate, for use in receiving and aiding a movement of a portion of a flexible pouring spout downwardly between the adjacent meter gates as the gates are closed, the concaved area permitting the portion of the flexible pouting spout to slide within the concaved area as a bulk product is discharged through the flexible pouring spout thereby preventing the pouring spout from bunching up on the upstream side of the gate.

9. A method of quickly and accurately controlling the flow of bulk material contained in a bulk material container having a tightly tied lower flexible pouring spout for use in pouring and distributing, to a plant operation, bulk material from the bulk material container whenever the tightly tied flexible pouring spout is untied and then subsequently re-tied for later use by a worker, comprising the steps of:

(a) providing a metering device having a metering gate discharger contained within the metering device, the metering device having a hopper with an open top and bottom portion capable of receiving the tightly tied flexible pouring spout of the bulk material container;

(b) providing the metering gate discharger with means for preventing bunching of a pre-determined portion of the flexible pouring spout within the hopper and above the metering gate discharger;

(c) positioning the metering device upstream of the plant operation and below the bulk material container so that the metering device can be used to release and to control the flow of bulk material contained within the bulk material container, the metering device permitting the bulk material to flow downstream, in a controlled manner, to the plant operation and further permitting the pre-determined portion of the flexible pouring spout to move through the metering gate discharger so that the pre-determined portion may be tied and later untied for muse of the bulk material container;

(d) inserting a tightly tied flexible pouring spout of the bulk material container within the metering gate discharger while positioning the bulk material container on top of the hopper;

(e) operating the metering gate discharger to clamp the tightly tied flexible pouring spout, of the bulk material container, above the tied portion of the pouring spout to thereby hold and temporarily retain the bulk material within the pouring spout and within the bulk material container while preventing bunching up of the flexible pouring spout;

(f) untying the tied portion of the flexible pouring spout;

(g) operating the metering gate discharger, to move portions of the metering gate discharger so as to unclamp the flexible pouring spout and to control the flow of the bulk material through the pouring spout and downstream to the plant operation;

(h) operating the metering gate discharger to again clamp the flexible pouring spout when the bulk material container is partially emptied and to stop the flow of the bulk material through the flexible pouring spout, the metering gate discharger preventing bunching up of the flexible pouring spout when the flexible pouring spout is clamped;

(i) re-tying the flexible pouring spout tightly shut;

(j) operating the metering gate discharger to again unclamp the re-tied flexible pouring spout to permit the pouting spout to be removed from the metering gate discharger; and (k) removing the flexible pouring spout from the metering gate discharger along with bulk material container from the metering device by lifting the partially emptied bulk material container from the metering device.

10. The method as defined in claim 9 further comprising the steps of:

(1) repeating steps (d) through (k) as desired to further discharge more bulk material from the partially emptied bulk material container.

* * * * *